US008570311B2

(12) United States Patent
Airault et al.

(10) Patent No.: US 8,570,311 B2
(45) Date of Patent: Oct. 29, 2013

(54) DISPLAY DEVICE INCLUDING A LIQUID CRYSTAL SCREEN WITH SECURED DISPLAY

(75) Inventors: Philippe Airault, Lege (FR); Laurent Canal, Merignac (FR); Gérard Voisin, St. Medard en Jalles (FR)

(73) Assignee: Thales, Neuilly-sur-Seine (FR)

( * ) Notice: Subject to any disclaimer, the term of this patent is extended or adjusted under 35 U.S.C. 154(b) by 777 days.

(21) Appl. No.: 12/676,901

(22) PCT Filed: Aug. 25, 2008

(86) PCT No.: PCT/EP2008/061067

§ 371 (c)(1),
(2), (4) Date: Mar. 17, 2010

(87) PCT Pub. No.: WO2009/030603

PCT Pub. Date: Mar. 12, 2009

(65) Prior Publication Data

US 2010/0201665 A1 Aug. 12, 2010

(30) Foreign Application Priority Data

Sep. 7, 2007 (FR) ..... 07 06283

(51) Int. Cl.
*G09G 5/00* (2006.01)

(52) U.S. Cl.
USPC ..... 345/208; 345/204; 345/207; 345/209; 345/211; 345/213

(58) Field of Classification Search
USPC ..... 345/87–107, 204–215; 349/37–49, 156; 359/264, 267; 385/16
See application file for complete search history.

(56) References Cited

U.S. PATENT DOCUMENTS

| | | | | |
|---|---|---|---|---|
| 5,177,475 | A * | 1/1993 | Stephany et al. | 345/96 |
| 5,472,635 | A * | 12/1995 | Iida et al. | 349/117 |
| 6,166,714 | A | 12/2000 | Kishimoto | |
| 6,201,522 | B1 * | 3/2001 | Erhart et al. | 345/96 |
| 6,531,997 | B1 * | 3/2003 | Gates et al. | 345/107 |
| 6,970,155 | B2 * | 11/2005 | Cabrera | 345/107 |
| 7,058,252 | B2 * | 6/2006 | Woodgate et al. | 385/16 |
| 7,724,270 | B1 * | 5/2010 | Lum et al. | 345/698 |
| 8,390,552 | B2 * | 3/2013 | Miyashita | 345/90 |

(Continued)

FOREIGN PATENT DOCUMENTS

| | | | |
|---|---|---|---|
| FR | 2 763 734 | A1 | 11/1998 |
| WO | 98/53366 | A1 | 11/1998 |
| WO | 2009/019253 | A1 | 2/2009 |

*Primary Examiner* — Prabodh M Dharia
(74) *Attorney, Agent, or Firm* — Baker & Hostetler LLP

(57) ABSTRACT

The general field of the invention is that of display devices including a liquid-crystal matrix screen composed of elementary pixels, said screen including at least a first electrode used as voltage reference and called the "backplane," a second electrode in the form of a matrix electronic network delivering the drive voltages for controlling the pixels and control electronics for said electrodes, said screen being used in the so-called "normally black" mode, that is to say that in the absence of applied voltages, the optical transmission of the pixels is substantially zero. In the device according to the invention, the "backplane" drive voltage is a variable periodic voltage, the amplitude of variation of this voltage being sufficient so that in the absence of voltage on the second electrode, the optical transmission of the pixels is sufficient to be detected by an observer.

5 Claims, 4 Drawing Sheets

(56) References Cited

U.S. PATENT DOCUMENTS

| | | | | |
|---|---|---|---|---|
| 2001/0045946 | A1* | 11/2001 | Huang et al. | 345/211 |
| 2002/0145698 | A1* | 10/2002 | Imai et al. | 349/156 |
| 2003/0090448 | A1* | 5/2003 | Tsumura et al. | 345/87 |
| 2004/0066362 | A1 | 4/2004 | Pai | |
| 2005/0001807 | A1 | 1/2005 | Lee et al. | |
| 2005/0285837 | A1* | 12/2005 | Akimoto | 345/96 |
| 2006/0125715 | A1* | 6/2006 | Choi | 345/14 |
| 2006/0132418 | A1 | 6/2006 | Morita | |
| 2007/0002009 | A1* | 1/2007 | Pasch et al. | 345/108 |
| 2007/0206262 | A1* | 9/2007 | Zhou | 359/267 |
| 2007/0285595 | A1* | 12/2007 | Hirao | 349/56 |
| 2008/0136765 | A1* | 6/2008 | Neugebauer | 345/98 |
| 2008/0231641 | A1* | 9/2008 | Miyashita | 345/619 |
| 2008/0252668 | A1* | 10/2008 | Chen | 345/690 |
| 2009/0015530 | A1* | 1/2009 | Goetz et al. | 345/89 |
| 2009/0073156 | A1* | 3/2009 | Fryer et al. | 345/211 |
| 2010/0033465 | A1 | 2/2010 | Canal et al. | |
| 2010/0157180 | A1* | 6/2010 | Doane et al. | 349/25 |

* cited by examiner

DISPLAY DEVICE INCLUDING A LIQUID CRYSTAL SCREEN WITH SECURED DISPLAY

CROSS-REFERENCE TO RELATED APPLICATIONS

This application is a National Stage of International patent application PCT/EP2008/061067, filed on Aug. 25, 2008, which claims priority to foreign French patent application No. FR 07 06283, filed on Sep. 7, 2007, the disclosures of which are hereby incorporated by reference in their entirety.

FIELD OF THE INVENTION

The field of the invention is that of liquid-crystal flat screens requiring a high degree of security.

BACKGROUND OF THE INVENTION

In the aeronautical field, safety constitutes one of the fundamental parameters. Having regard to increases in air traffic, aircraft manufacturers and airline companies are imposing ever more ambitious objectives on equipment manufacturers. In the field of cockpit displays, any display of erroneous images is henceforth prohibited.

For many years, liquid-crystal flat screens have been prevalent in the field of displays. They are, inter alia, used to effect the displays of aircraft instrument panels.

Conventionally, a liquid-crystal display, termed LCD, essentially comprises a lighting source and a matrix-like optical modulator. The matrix proper is a pane composed of a stack of various layers. FIG. 1 represents a partial exploded view of an LCD matrix. In this view, the white arrow indicates the direction of propagation of the light through the matrix. The latter comprises in succession:

- A first rear polarizer 1 disposed on the lighting source side;
- A first glass sheet 2 which comprises the matrix control electronics 3 composed mainly of a horizontal control bus and of a vertical control bus, the control electronics commonly being called "drivers" according to the conventional terminology;
- A first support plate 4 for the liquid crystal;
- The liquid crystal 5;
- A second support plate 6 for the liquid crystal bearing a counter-electrode also called the "backplane" 7;
- A matrix network 8 of triples of colored filters. Each triple corresponds to a pixel also known by the term colored "dot" of the image;
- A second glass sheet 9;
- A second rear polarizer 10 disposed on the observer's side.

The display operates as follows. The light source is polarized at the rear of the pane by the first polarizer 1. The light passes through the liquid crystal, the colored filters 8 and emerges through the second polarizer 10. The polarization of the light is phase-shifted by 90 degrees when it passes through the liquid crystal whilst quiescent.

There are two chief possible operating modes. In the first mode, the polarization axis of the second polarizer is perpendicular to that of the first polarizer. In this case, the light issuing from the pane, after passing through the liquid crystal, has the same polarization state as the second polarizer and can emerge. This mode is called the "white mode" or else "normally white". In the second mode, the polarization axis of the second polarizer is parallel to that of the first polarizer. In this case, the light issuing from the pane is polarized at 90 degrees to the polarization axis of the second polarizer and cannot emerge. This mode is called the "black mode" or else "normally black".

In both cases, following the drive command applied to the liquid crystal, the light passing through the latter will be phase-shifted by it to a greater or lesser extent, and only a fraction of the light passes through the front polarizer as a function of the phase shift generated. Gray shades are thus created on each colored filter. It is thus possible to generate a pixel or a "dot" having a given color either in "normally white" mode or in "normally black" mode.

The first LCD screens used solely a structure termed "twisted nematic" or TN. This structure made it possible to produce LCD cells termed "normally white". Not driven, the "dots" were luminous.

In the aeronautical field, the dots of colors were organized into quadruples called "quads" and column "drive" or control circuits, mounted interleaved, so-called "Stripe" mode, were used in order to cover the loss of a video link.

These cells used a drive mode called "backplane switching" to control the matrix.

Moreover, the first displays exhibited technological weaknesses. The liquid crystal had a low time constant and the amorphous silicon "MOS" transistors had sizeable current leakages.

Now, avionics graphical images generally use a dark background to improve the contrast of the plots. On the first LCD screens, a fault then created an abnormal luminous zone that the pilot detected immediately. Consequently, the technical characteristics of the first LCD displays readily allowed visual detection of faults in the display and the associated electronics. In conclusion, safety was ensured naturally.

Progress with liquid crystals, with column drivers and with the manufacture of active matrices has allowed the use of a drive mode of control called "fixed backplane". The viewing angle of the matrices has been increased by introducing new structures and new configurations of matrices. So-called MVA matrices, the acronym standing for "Multi-domain Vertical Alignment" or IPS matrices, the acronym standing for "In Plane Switching", will be cited by way of example. These new matrices are in "normally black" mode. The non-driven cell is therefore black. This therefore minimizes the effect of faulty pixels which are then predominantly black, contrary to "normally white" TN type matrices whose predominantly luminous defective pixels are abundantly evident.

Of course, these matrices which possess better optical performance are used in the aeronautical field. Unfortunately, these cosmetic or esthetic advantages introduce a complication as regards safety. With these new matrices, a fault creates a dark zone which may seem normal, whereas the useful information has disappeared. Thus, a fault with a video link may cause the loss of the red pixels. This fault makes the red alerts disappear and transforms the yellow and orange alerts into green-colored information. Moreover, faults with the "line drivers" of LCD matrices create frozen images which may have a remanence of the order of a minute and are therefore deemed unacceptable. These events are obviously strictly prohibited in aeronautical applications.

SUMMARY OF THE INVENTION

The device according to the invention makes it possible to solve or to greatly attenuate the above drawbacks, while preserving the advantages of the use of a "normally black" LCD display. To solve the safety problem, a percentage of switching of the "backplane" voltage is introduced into the LCD drive circuit.

More precisely, the subject of the invention, as illustrated in FIG. 8, is a display device 802 including at least one liquid-crystal matrix screen 804 composed of elementary pixels 806, said screen 804 including at least a first electrode 808 used as voltage reference and called the "backplane", a second electrode 810 in the form of a matrix electronic network delivering the drive voltages for controlling the pixels 806 and control electronics 812 for said electrodes 808, 810, said screen 804 being used in the so-called "normally black" mode, that is to say that in the absence of applied voltages, the optical transmission of the pixels 806 is substantially zero, characterized in that the "backplane" drive voltage is a variable periodic voltage, the amplitude of variation of this voltage being sufficient so that in the absence of voltage on the second electrode, the optical transmission of the pixels 806 is sufficient to be detected by an observer.

Advantageously, the drive voltage for controlling the pixels 806 is periodic, the amplitude of variation of said voltage being centered on the "backplane" drive voltage in such a way that on average the pixel 806 is subjected to a zero voltage.

Advantageously, the "backplane" drive voltage over a period has a first constant value during a first half-period and a second constant value, different from the first value, during a second half-period.

More precisely, the drive voltage for controlling the pixels 806 has a maximum amplitude corresponding to a maximum optical transmission, said maximum amplitude being about three times greater than the amplitude of variation of the "backplane" voltage and the frequency of variation of the "backplane" drive voltage is of the same order of magnitude as the image refresh frequency, denoted frame frequency.

Finally, the liquid-crystal matrix screen 804 is preferably of the MVA type, the acronym standing for "Multi-domain Vertical Alignment", or the IPS type, the acronym standing for "In Plane Switching".

BRIEF DESCRIPTION OF THE DRAWINGS

The invention will be better understood and other advantages will become apparent on reading the nonlimiting description which follows and by virtue of the appended figures among which.

DETAILED DESCRIPTION

The figures numbered from 2 to 7 represent the variations as a function of time of the amplitude of the drive voltages for controlling the "backplane" B and the electrode C for controlling the pixels. The "backplane" drive voltage is represented chain-dotted and the electrode drive voltage is represented by a solid line. In the top left part of each figure, the transmission obtained is represented by a white, gray or black square.

Figure 1:
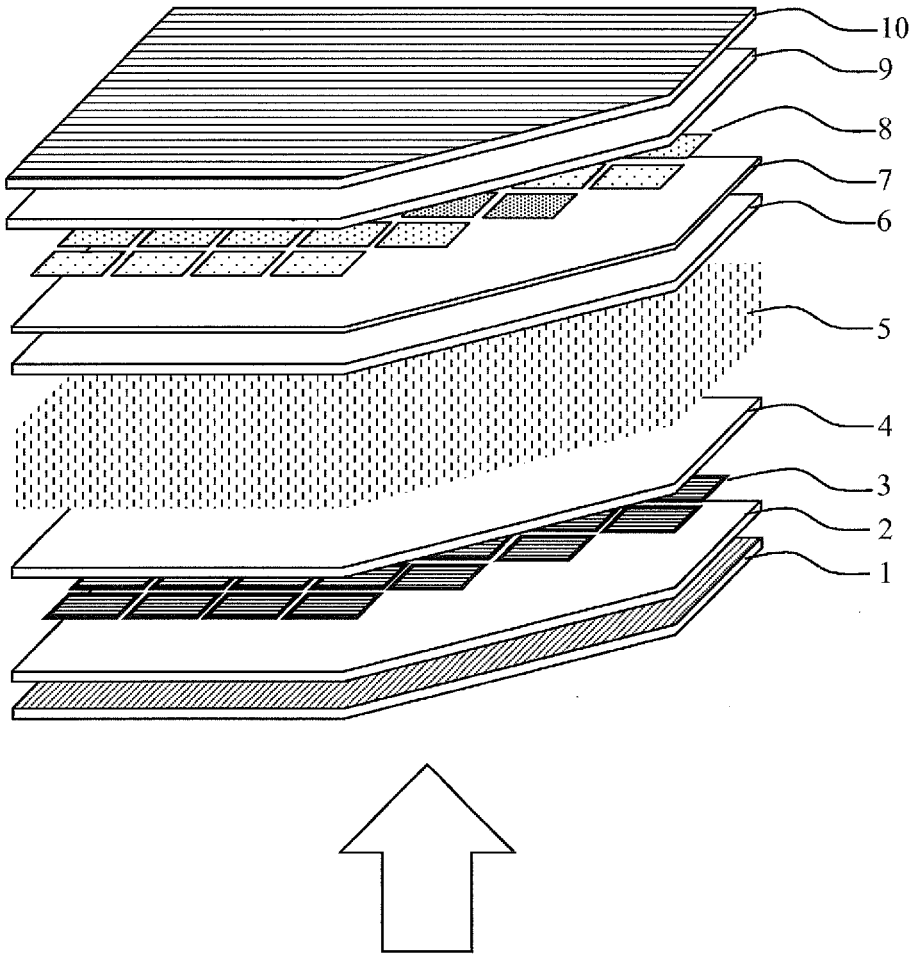
FIG. 1 PRIOR ART
FIG. 1 represents a sectional view of an LCD matrix.
Figure 2:
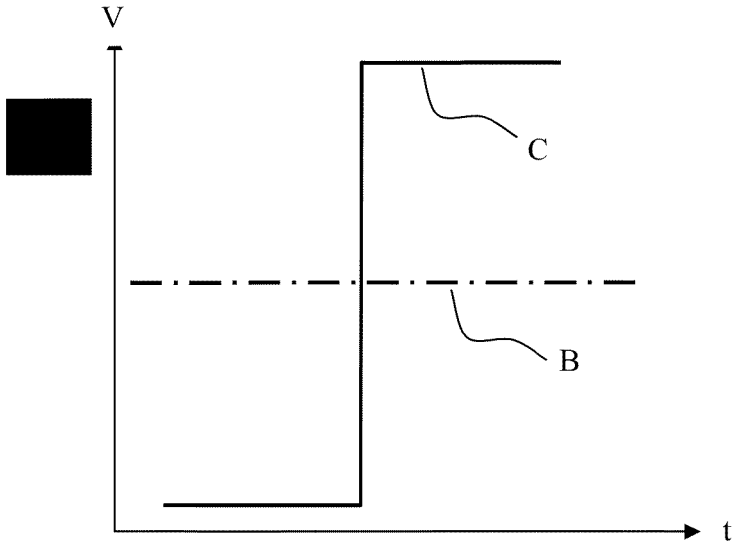
FIGS. 2, 3 and 4 represent the variation over time of the drive voltages for controlling the pixels in the case of a "normally white" LCD matrix according to the prior art.
Figure 3:
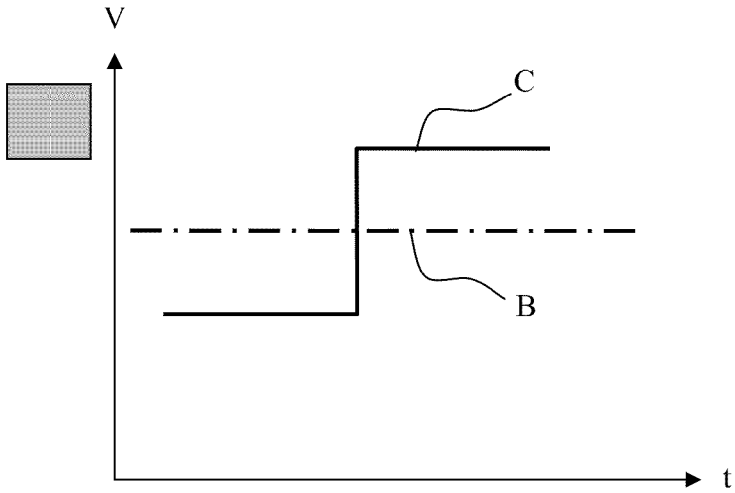
Figure 4:
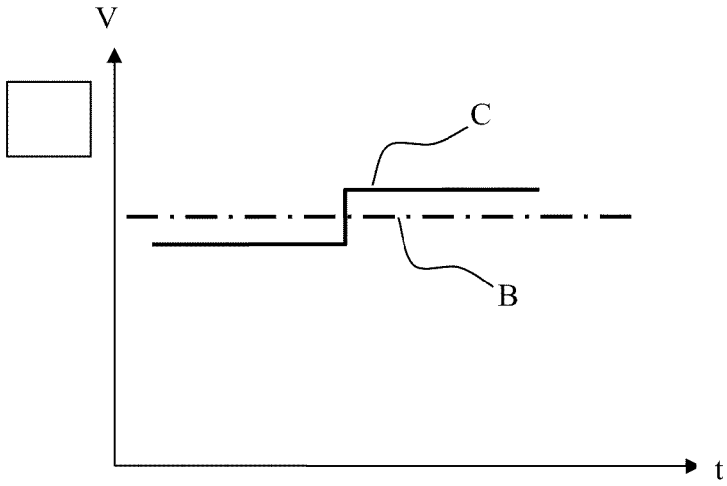

FIGS. 2, 3 and 4 represent the variation over time of the drive voltages for controlling the pixels in the case of a "normally white" LCD matrix. As seen in these figures, the "backplane" voltage is constant. The drive voltage for controlling the pixels is in the form of a periodic notch. The maximum amplitudes of the voltages are of the order of 12 volts. Each notch is centered on the "backplane" voltage. Thus, the liquid crystal situated between the control electrode and the "backplane" sees a zero mean voltage. This therefore avoids marking the screen.

The amplitude of the notches dictates the transmission of the pixel. Thus, as illustrated in FIG. 2, a large amplitude generates a black pixel, a mean amplitude a gray pixel (FIG. 3) and a low amplitude a white pixel (FIG. 4).

Figure 5:
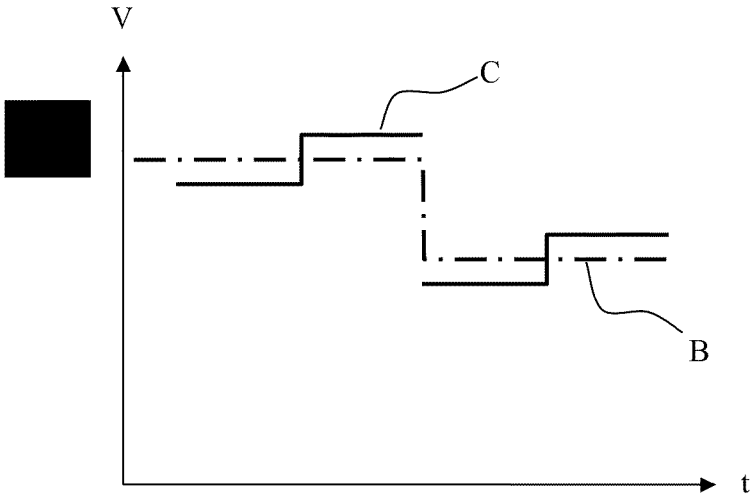
FIGS. 5, 6 and 7 represent the variation over time of the drive voltages for controlling the pixels in the case of a "normally black" LCD matrix according to the invention.
Figure 6:
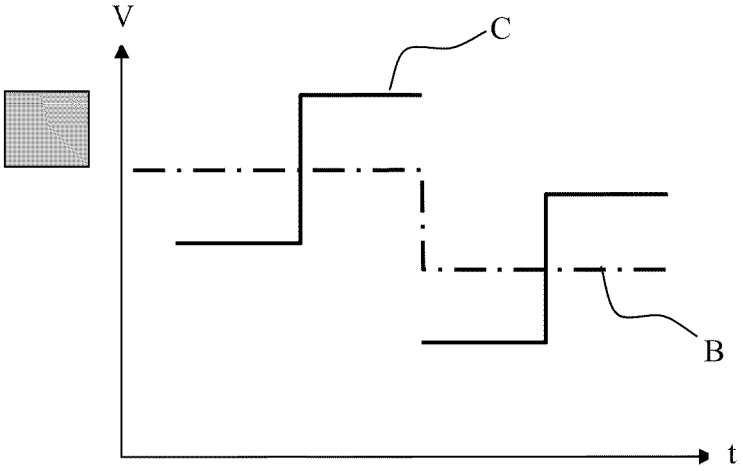
Figure 7:
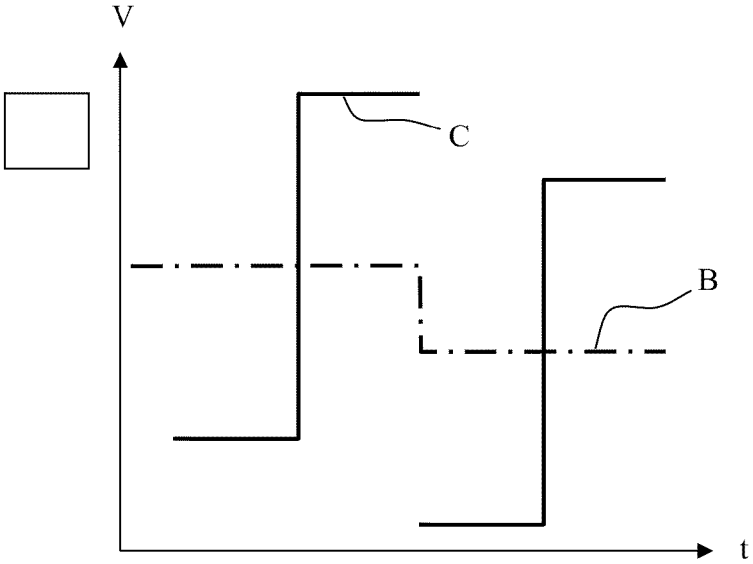
Figure 8:
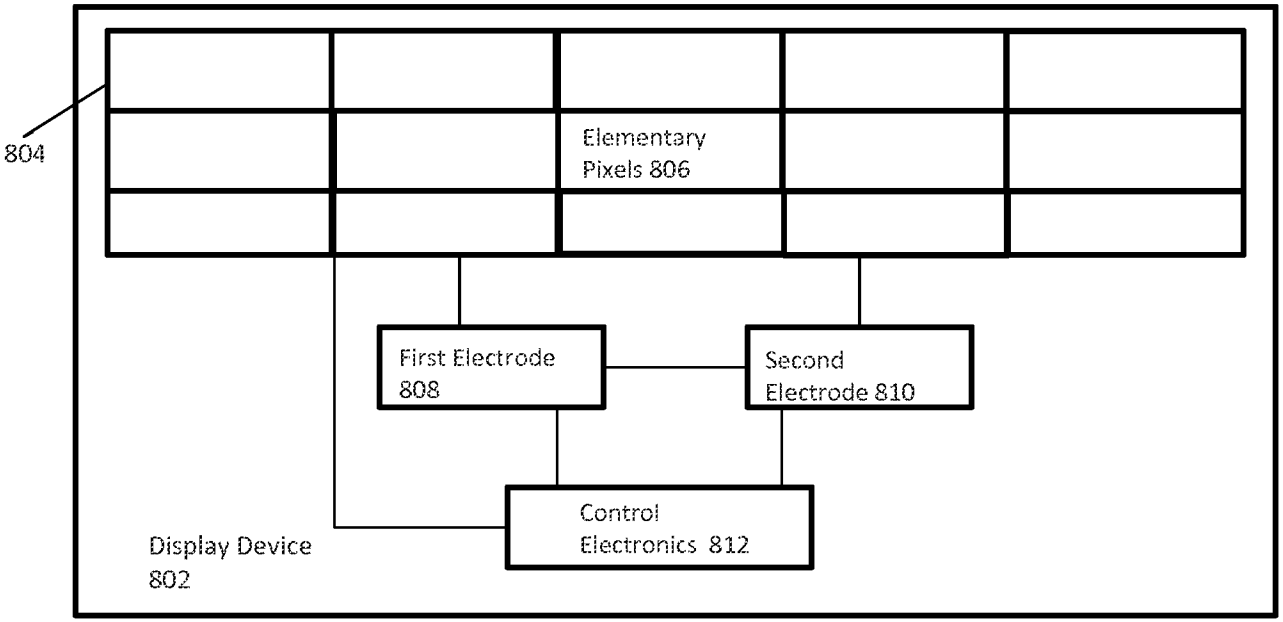
FIG. 8 illustrates a display device according to one embodiment of the invention.

FIGS. 5, 6 and 7 represent the variation over time of the drive voltages for controlling the pixels 806 in the case of a "normally black" LCD matrix screen 804 according to the invention. As seen in these figures, the "backplane" voltage is variable. The simplest variation to achieve and which is represented in these figures is to vary the voltage periodically between two constant voltage levels. The drive voltage for controlling the pixels 806 is also in the form of a periodic notch. The maximum amplitudes of the voltages are of the order of 12 volts. Each notch is centered on the "backplane" voltage in such a way that the liquid crystal situated between the control electrode and the "backplane" sees a zero mean voltage, as seen in FIGS. 5, 6 and 7.

The amplitude of the notches dictates the transmission of the pixel. Thus, as illustrated in FIG. 5, a low amplitude generates a black pixel, a mean amplitude a gray pixel (FIG. 6) and a large amplitude a white pixel (FIG. 7).

The "backplane" switches at a low frequency which may be, for example, the frame frequency so as not to have any problems during electro-magnetic compatibility trials. Thus, the "backplane" voltage is not disturbed and in return, does not disturb. The drive voltages for controlling the pixels termed GMA, the acronym standing for "Gamma Modulation Amplitude", are the sum of the variation of the backplane and of the voltage that one actually wishes to apply to the "dot".

If the control electronics 812 for driving the pixels 806 is faulty, the origin of the fault possibly stemming either from the digital video, or from the GMA voltage generator, the switching of the "backplane" voltage suffices to drive the dot to gray. The background of the image is no longer black and the pilot detects the fault as in the past. Likewise, if the control circuit of the "backplane" is broken, the dots will all be controlled by the columns and none will be black. Of course, the device 802 does not make it possible to compensate for simultaneous faults with the control electronics 812 and with the "backplane", but these simultaneous faults are highly improbable, given the very high level of reliability of the electronic components for controlling electronic displays for their use in the aeronautical field.

The proposed device makes it possible to ensure the safety of "normally black" LCD screens by reproducing the effects that were present in the past when a "normally white" matrix developed a fault. These effects are acceptable to aircraft manufacturers and aeronautical certification authorities.

The modifications to be made to the control software which consist essentially in having a variable "backplane" voltage instead of a fixed voltage are negligible and have no significant impacts either on the costs or on the reliability of the display device.

The invention claimed is:

1. A display device comprising:

at least one liquid-crystal matrix screen composed of elementary pixels, wherein said at least one liquid-crystal matrix screen comprising:

at least a first electrode used as voltage reference and called the "backplane";

a second electrode arranged in a form of a matrix electronic network delivering drive voltages for controlling the elementary pixels and control electronics for said first and second electrodes, said at least one liquid-crystal matrix screen being used in a "normally black" mode, that is to say that the maximum amplitude of the drive voltages for controlling the elementary pixels corresponds to a maximum optical transmission, wherein the drive voltage applied to the "backplane" is a variable periodic voltage having an amplitude variation representing about a third of the maximum amplitude of the drive voltages for controlling the elementary pixels, wherein the amplitude variation being sufficient so that in an absence of voltage on the second electrode, the optical transmission of the elementary pixels is sufficient to be detected by an observer.

2. The display device as claimed in claim 1, wherein the drive voltages for controlling the elementary pixels is periodic, the amplitude of variation of said drive voltage being centered on the drive voltage applied to the "backplane" in such a way that on average the elementary pixel is subjected to a zero voltage.

3. The display device as claimed in claim 1, wherein the drive voltage applied to the "backplane" over a period has a first constant value during a first half-period and a second constant value, different from the first value, during a second half-period.

4. The display device as claimed in claim 1, wherein the drive voltage applied to the "backplane" has a frequency variation that is of same order of magnitude as an image refresh frequency, denoted frame frequency.

5. The display device as claimed in claim 1, wherein the liquid-crystal matrix screen is of the at least one of a multi-domain vertical alignment (MVA) or an in plane switching (IPS) type.

* * * * *